US011878895B2

(12) United States Patent
Yang et al.

(10) Patent No.: US 11,878,895 B2
(45) Date of Patent: Jan. 23, 2024

(54) CABLE COILING SYSTEM

(71) Applicant: Tyco Electronics (Shanghai) Co. Ltd., Shanghai (CN)

(72) Inventors: An Yang, Shanghai (CN); Lvhai Hu, Shanghai (CN)

(73) Assignee: Tyco Electronics (Shanghai) Co., Ltd., Shanghai (CN)

( * ) Notice: Subject to any disclaimer, the term of this patent is extended or adjusted under 35 U.S.C. 154(b) by 371 days.

(21) Appl. No.: 17/372,967

(22) Filed: Jul. 12, 2021

(65) Prior Publication Data

US 2022/0009743 A1 Jan. 13, 2022

(30) Foreign Application Priority Data

Jul. 13, 2020 (CN) ..... 202010670881.3

(51) Int. Cl.

| | |
|---|---|
| ***B65H 75/44*** | (2006.01) |
| ***B65H 57/00*** | (2006.01) |
| ***B65H 54/54*** | (2006.01) |
| ***B65H 54/44*** | (2006.01) |
| ***B65H 54/28*** | (2006.01) |

(52) U.S. Cl.

CPC ..... *B65H 75/44* (2013.01); *B65H 54/2803* (2013.01); *B65H 54/44* (2013.01); *B65H 54/54* (2013.01); *B65H 57/006* (2013.01); *B65H 2701/34* (2013.01)

(58) Field of Classification Search

None

See application file for complete search history.

(56) References Cited

U.S. PATENT DOCUMENTS

| | | | | |
|---|---|---|---|---|
| 1,849,693 | A * | 3/1932 | Root | B65H 57/006 242/157 R |
| 3,975,883 | A * | 8/1976 | Besnyo | B65H 67/04 53/118 |
| 6,948,675 | B2 * | 9/2005 | Frommenwiler | H02G 11/02 242/362.2 |
| 10,023,426 | B2 * | 7/2018 | Boccato | B65H 54/62 |
| 2019/0382230 | A1 * | 12/2019 | Hamada | B60R 16/027 |

FOREIGN PATENT DOCUMENTS

| | | | |
|---|---|---|---|
| CN | 107140454 | * | 9/2017 |
| JP | 2013161740 | * | 8/2013 |
| WO | WO 2021065755 | * | 4/2021 |

* cited by examiner

*Primary Examiner* — William A. Rivera

(74) *Attorney, Agent, or Firm* — Barley Snyder

(57) ABSTRACT

A cable coiling system for coiling a cable into a cable coil includes a reel rotatable around a central axis of the reel, a gripper configured to grip a starting end of the cable, and a slide rail extending in a direction perpendicular to the central axis of the reel. The cable is coilable around the reel to form the cable coil by rotating the reel in a state in which the gripper is coupled onto the reel and grips the starting end of the cable. The reel is slidably mounted on the slide rail. A length of the starting end of the cable coiled around the reel is adjustable by moving the reel along the slide rail and rotating the reel around the central axis in a state in which the gripper is separated from the reel and fixed at a predetermined position.

20 Claims, 5 Drawing Sheets

CABLE COILING SYSTEM

CROSS-REFERENCE TO RELATED APPLICATION

This application claims the benefit of the filing date under 35 U.S.C. § 119(a)-(d) of Chinese Patent Application No. 202010670881.3, filed on Jul. 13, 2020.

FIELD OF THE INVENTION

The present invention relates to a cable and, more particularly, to a cable coiling system.

BACKGROUND

During manufacturing of a cable, the cable needs to be coiled into a cable coil in order to facilitate transportation and storage. In order to facilitate subsequent application for a user, it is desirable that a total length of the cable of each cable coil is equal to a predetermined total length, and it is also desirable that lengths of two free ends of each cable coil are equal to a predetermined length. However, none of the existing cable coiling equipment can achieve this purpose; the lengths of the two free ends of the cable coil cannot be made equal to a predetermined length by the existing cable coiling equipment.

SUMMARY

A cable coiling system for coiling a cable into a cable coil includes a reel rotatable around a central axis of the reel, a gripper configured to grip a starting end of the cable, and a slide rail extending in a direction perpendicular to the central axis of the reel. The cable is coilable around the reel to form the cable coil by rotating the reel in a state in which the gripper is coupled onto the reel and grips the starting end of the cable. The reel is slidably mounted on the slide rail. A length of the starting end of the cable coiled around the reel is adjustable by moving the reel along the slide rail and rotating the reel around the central axis in a state in which the gripper is separated from the reel and fixed at a predetermined position.

BRIEF DESCRIPTION OF THE DRAWINGS

The invention will now be described by way of example with reference to the accompanying Figures, of which.

DETAILED DESCRIPTION OF THE EMBODIMENTS

Figure 1:
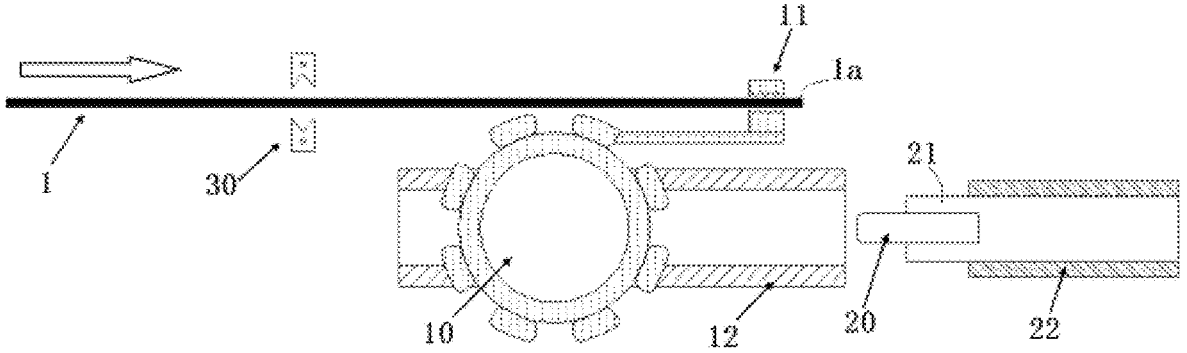
FIG. 1 is a schematic side view of a cable coiling system according to an embodiment in which a gripper is coupled to a reel and grips a starting end of a cable.

The technical solutions of the disclosure will be described hereinafter in further detail with reference to the following embodiments, taken in conjunction with the accompanying drawings. In the description, the same or similar reference numerals indicate the same or similar parts. The description of the embodiments of the disclosure hereinafter with reference to the accompanying drawings is intended to explain the general inventive concept of the disclosure and should not be construed as a limitation on the disclosure.

In addition, in the following detailed description, for the sake of explanation, numerous specific details are set forth in order to provide a thorough understanding of the disclosed embodiments. It will be apparent, however, that one or more embodiments may also be practiced without these specific details. In other instances, well-known structures and devices are illustrated schematically in order to simplify the drawings.

Figure 2:
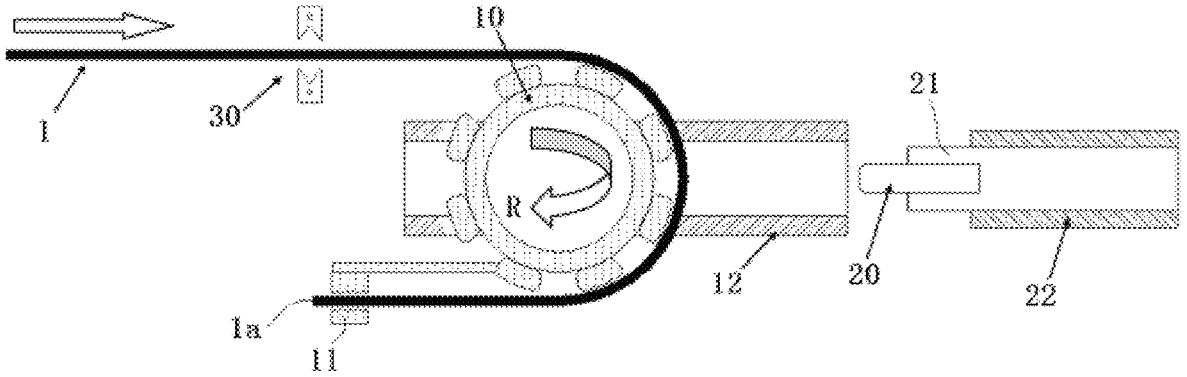
FIG. 2 is a schematic side view of the cable coiling system with the cable initially coiled by rotating the reel.
Figure 3:
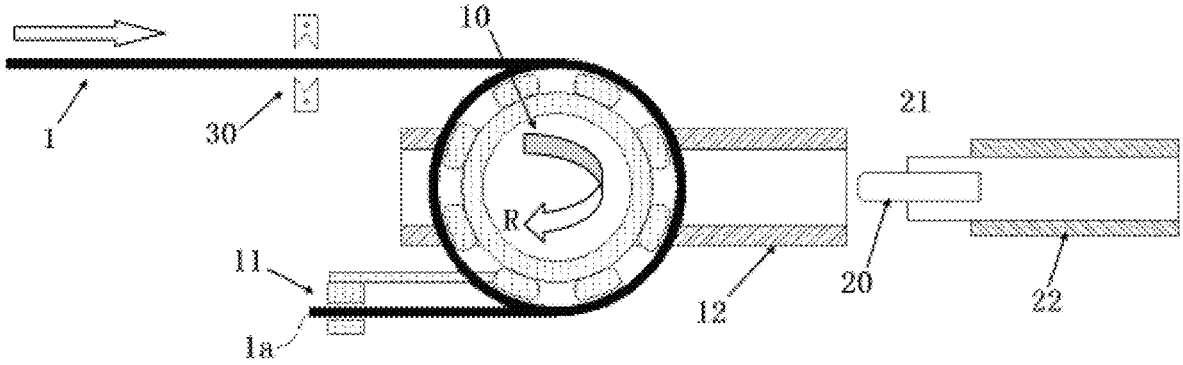
FIG. 3 is a schematic side view of the cable coiling system with the cable coiled into a cable coil by further rotation of the reel.

FIG. 1 shows a schematic view of a cable coiling system according to an exemplary embodiment of the disclosure in which a gripper 11 is coupled to a reel 10 and grips a starting end 1*a* of a cable 1 to be coiled. FIG. 2 shows a schematic view illustrating that the cable 1 is initially coiled by rotating the reel 10 shown in FIG. 1. FIG. 3 shows a schematic view illustrating that the cable 1 is coiled into a cable coil by further rotating the reel 10 shown in FIG. 2.

As shown in FIGS. 1 to 3, in the illustrated embodiment, a cable coiling system is configured to coil 1 cable into a cable coil. The cable coiling system includes a reel 10 and a gripper 11. The reel 10 is rotatable around its central axis and configured to coil the cable 1 therearound. The gripper 11 is configured to grip a starting end 1*a* (also called a free end) of the cable 1 to be coiled. As shown in FIGS. 1 to 3, in the illustrated embodiment, the cable 1 is coilable around the reel 10 by rotating the reel 10 in a state where the gripper 11 is coupled onto the reel 10 and grips the starting end 1*a* of the cable 1.

Figure 4:
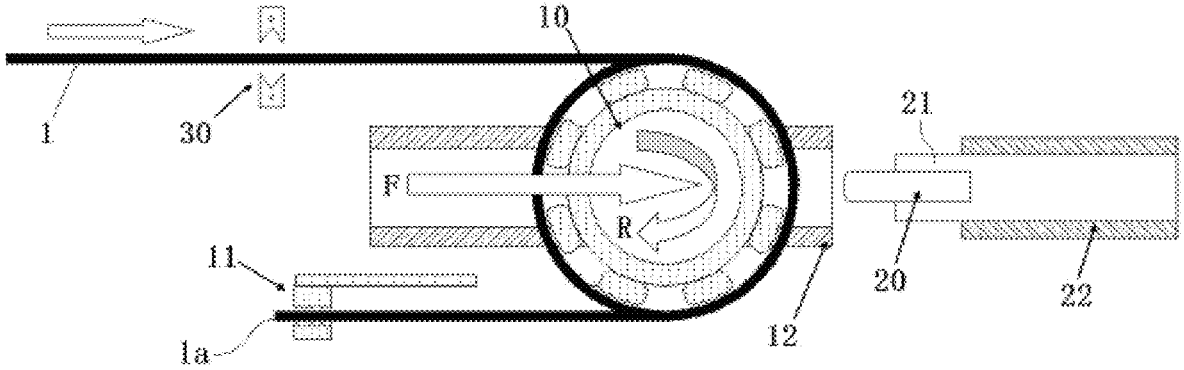
FIG. 4 is a schematic side view of the cable coiling system adjusting a length of a starting end of the cable coil.
Figure 5:
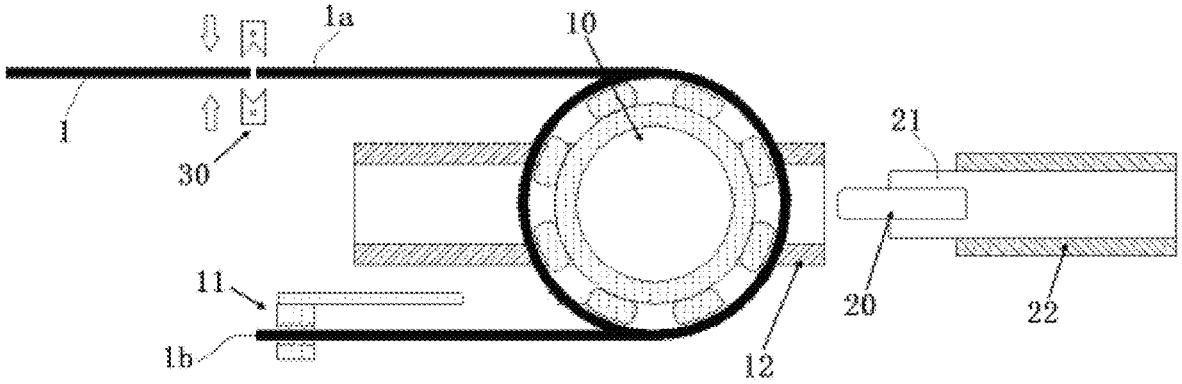
FIG. 5 is a schematic side view of the cable coiling system with the length of the starting end of the cable coil adjusted to a predetermined length.

FIG. 4 shows a schematic view of adjusting a length of the starting end 1*a* of the cable coil shown in FIG. 3, in which the gripper 11 is separated from the reel 10 and fixed at a predetermined position and the reel 10 moves along a slide rail 12 and further rotates. FIG. 5 shows a schematic view illustrating that the length of the starting end 1*a* of the cable coil shown in FIG. 4 is adjusted to a predetermined length A.

As shown in FIGS. 1 to 5, in the illustrated embodiment, the cable coiling system further includes a slide rail 12 extending in a direction perpendicular to the central axis of the reel 10. The reel 10 is slidably mounted on the slide rail 12.

Figure 8:
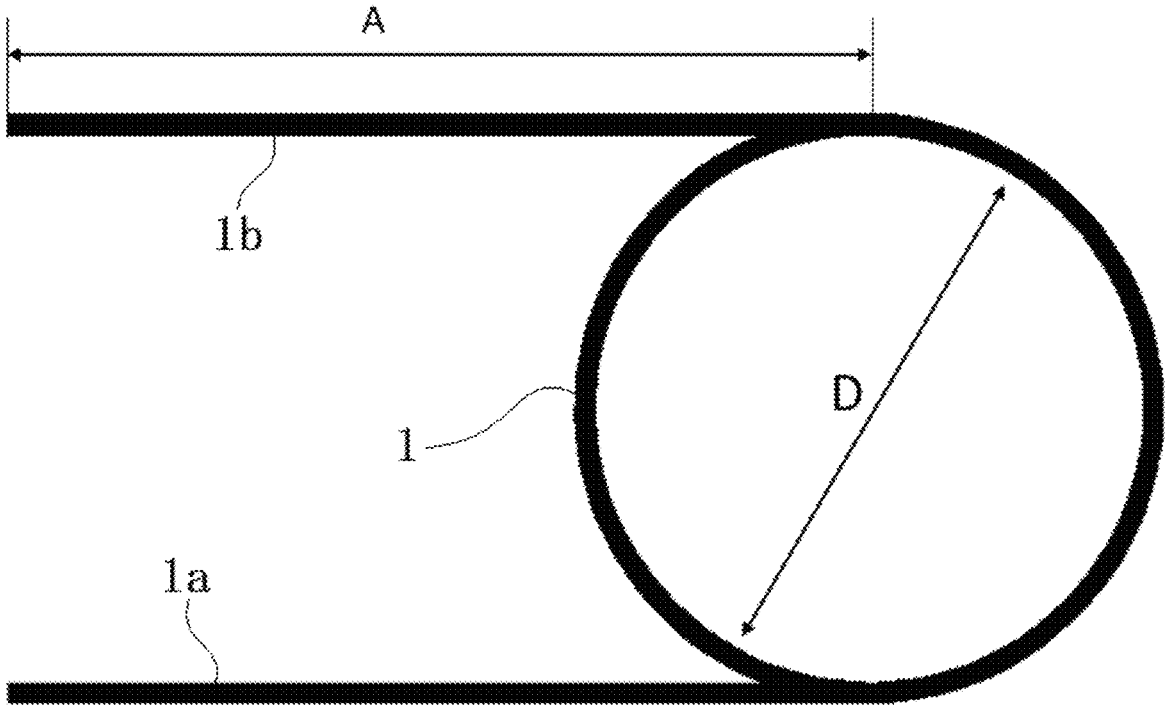
FIG. 8 is a schematic side view of a size of the cable coil in FIG. 5.
Figure 9:
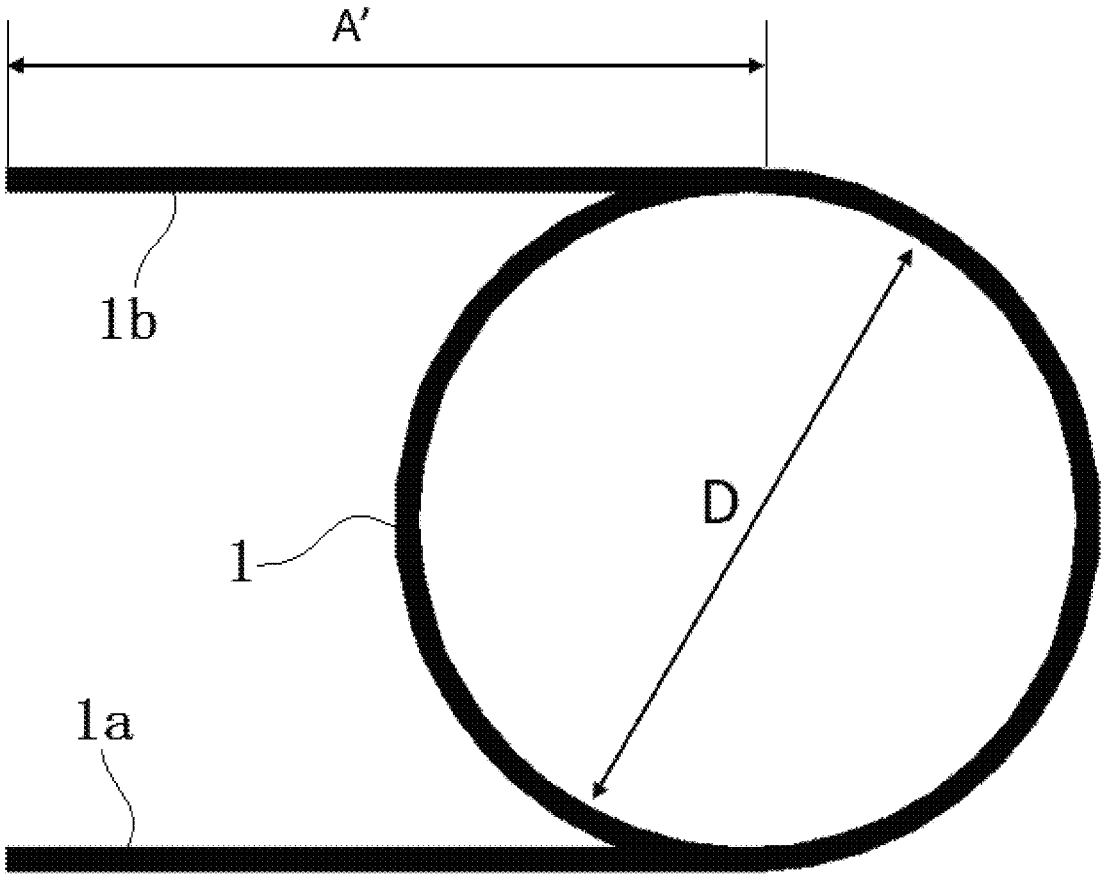
FIG. 9 is a schematic side view of a size of a coiled and bundled cable coil.

FIG. 8 shows a schematic view of a size of the cable coil shown in FIG. 5, and FIG. 9 shows a schematic view of a size of a coiled and bundled cable coil according to another exemplary embodiment of the disclosure.

As shown in FIGS. 4, 5, 8 and 9, in the illustrated embodiment, in a state where the gripper 11 is separated from the reel 10 and fixed at a predetermined position, a length A or A' of the starting end 1*a* of the cable coil coiled around the reel 10 is adjustable by moving the reel 10 along the slide rail 12 and rotating the reel 10 around the central axis (see FIGS. 8 and 9).

As shown in FIGS. 4, 5, 8 and 9, in the illustrated embodiment, during adjusting the length A or A' of the starting end 1*a*, the reel 10 slides along the slide rail 12 in an arrow direction F shown in the FIG. 4, while the reel 10 continues to rotate in a cable coiling direction R, so as to adjust and change the length of the starting end 1*a*, such that the length of the starting end 1*a* may be equal to different lengths A, A' (see FIGS. 8 and 9) such as the length A shown in FIG. 8 or the length A' shown in FIG. 9.

As shown in FIGS. 4, 5, 8 and 9, in the illustrated embodiment, the cable coiling system further includes a cutting device 30 configured to cut off the cable 1 at a feeding side of the reel 10 after the cable 10 is coiled around the reel 10, such that a length (A, A') of a terminating end (or the other free end) 1*b* of the cable coil coiled around the reel 10 is equal to the length (A, A') of the starting end 1*a*.

As shown in FIGS. 4, 5, 8 and 9, in the illustrated embodiment, a total length of the cable 1 of the cable coil includes a length of a coiled section of the cable 1 directly coiled around the reel 10 and the lengths A, A' of the starting end 1*a* and the terminating end 1*b* (or called the free ends 1*a* and 1*b*) which are not coiled around the reel 10. The total length of the cable 1 of the cable coil is equal to the predetermined total length by controlling the length of the coiled section and the lengths A, A' of the starting end 1*a* and the terminating end 1*b*.

As shown in FIGS. 4, 5, 8 and 9, in the illustrated embodiment, the length of the coiled section of the cable 1 of the cable coil is determined by an outer diameter D of the reel 10 and the number of turns of the cable 1 coiled around the reel 10, thereby the length of the coiled section may be controlled by controlling the number of turns of the cable 1 coiled around the reel 10. As shown in FIGS. 4, 5, 8 and 9, in the illustrated embodiment, the number of turns of the cable 1 coiled around the reel 10 may be controlled by controlling the number of rotations of the reel 10 during coiling the cable 1.

In an embodiment, the cable coiling system further includes a slider slidably assembled on the slide rail 12, and the reel 10 is rotatably mounted on the slider.

In an embodiment, the cable coiling system further includes a first driving device mounted on the slider and configured to drive the reel 10 to rotate around the central axis. In an embodiment, the first driving device has a servo motor, and the reel 10 is connected to an output shaft of the servo motor. In this way, the reel 10 may be driven to rotate by the servo motor.

In an embodiment, the cable coiling system further includes a second driving device configured to drive the reel 10 to move along the slide rail 12. The second driving device, in an embodiment, is an air cylinder or a hydraulic cylinder including a cylinder body and a piston rod. The piston rod of the second driving device is coupled onto the slider to push the slider and the reel 10 to move along the slide rail 12. However, the disclosure is not limited to the embodiments as described above, and the second driving device may also be other types of linear driver such as an electric cylinder.

Figure 6:
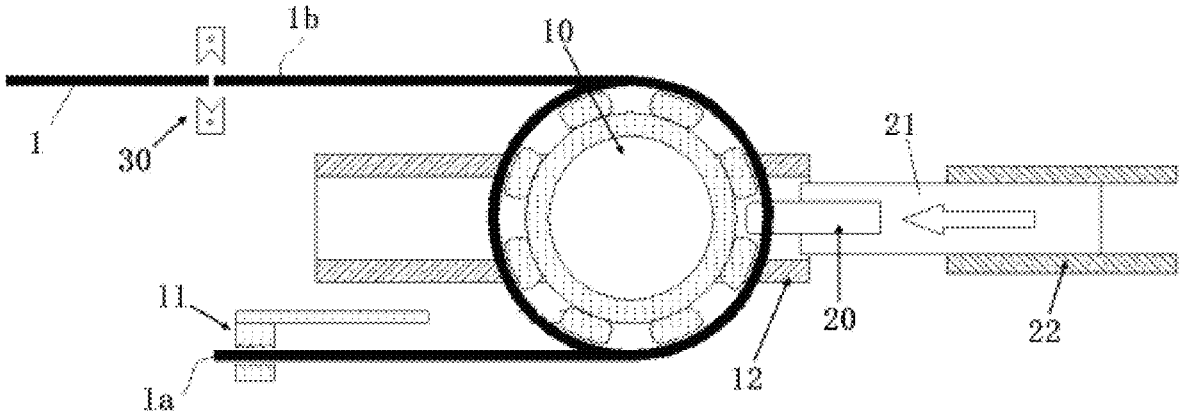
FIG. 6 is a schematic side view of the cable coiling system with a cable coil bundling device in a working position.
Figure 7:
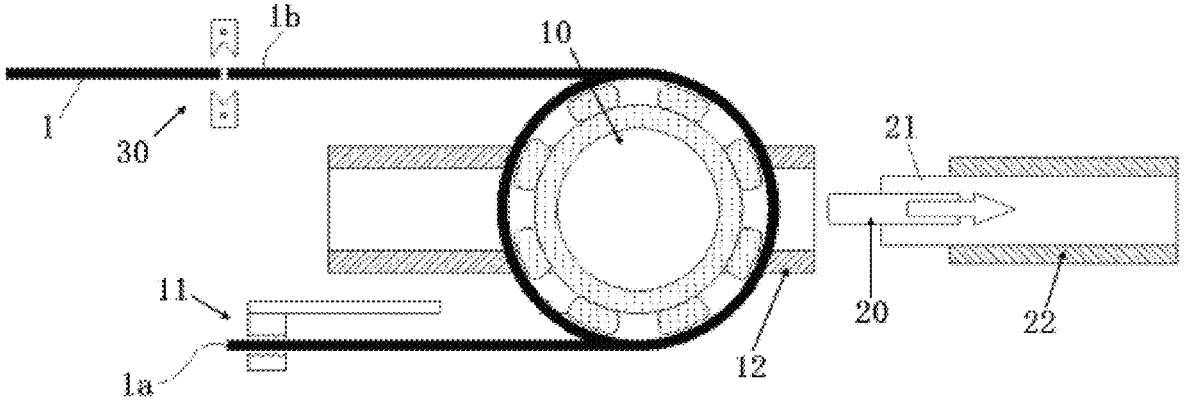
FIG. 7 is a schematic side view of the cable coiling system with the cable coil bundling device in a non-working position.

FIG. 6 shows a schematic view illustrating that a cable coil bundling device 20 moves to a working position and bundles the cable coil shown in FIG. 5. FIG. 7 shows a schematic view illustrating that the cable coil bundling device 20 moves to a non-working position away from the cable coil after the cable coil is bundled. As shown in FIGS. 6 and 7, the cable coiling system further includes a cable coil bundling device 20 configured to wrap a tape onto the cable coil to ensure that the coiled cable will not come loose.

As shown in the embodiment of FIGS. 6 and 7, the cable coiling system further includes a slidable guide rail 22. The cable coil bundling device 20 is slidably mounted on the slidable guide rail 22 so as to move along the slidable guide rail 22 between the working position at which the cable coil is bundled and the non-working position away from the cable coil. As shown in FIGS. 6 and 7, in the illustrated embodiment, the cable coiling system further includes a bundling slider 21 slidably assembled on the slidable guide rail 22, and the cable coil bundling device 20 is mounted on the bundling slider 21.

The cable coiling system further includes a driving mechanism configured to drive the cable coil bundling device 20 to move along the slidable guide rail 22. The driving mechanism may be an air cylinder or a hydraulic cylinder including a cylinder body and a piston rod. The piston rod of the driving mechanism is coupled onto the bundling slider 21 so as to push the bundling slider 21 and the cable coil bundling device 20 to move along the slidable guide rail 22. However, the disclosure is not limited to the embodiments as described above, and the driving mechanism may also include other types of linear drives such as an electric cylinder.

In the above various exemplary embodiments according to the disclosure, the cable coiling system may adjust and control the lengths of the free ends 1*a*, 1*b*, such as the starting end 1*a* and terminating end 1*b*, of the cable coil.

It should be appreciated by those skilled in this art that the above embodiments are intended to be illustrative, and many modifications may be made to the above embodiments by those skilled in this art. Further, various structures described in various embodiments may be freely combined with each other without conflicting in configuration or principle.

Although the disclosure has been described hereinbefore in detail with reference to the attached drawings, it should be appreciated that the disclosed embodiments in the attached drawings are intended to illustrate embodiments of the disclosure by way of example, and should not be construed as a limitation to the disclosure.

Although a few embodiments of the general inventive concept of the disclosure have been shown and described, it would be appreciated by those skilled in the art that changes or modifications may be made to these embodiments without departing from the principles and spirit of the general inventive concept, the scope of which is defined in the claims and their equivalents. It should be noted that, the word "include" or "comprise" doesn't exclude other elements or steps, and the word "a" or "an" doesn't exclude more than one.

What is claimed is:

1. A cable coiling system for coiling a cable into a cable coil, comprising:

a reel rotatable around a central axis of the reel;

a gripper configured to grip a starting end of the cable, the cable is coilable around the reel to form the cable coil by rotating the reel in a state in which the gripper is coupled onto the reel and grips the starting end of the cable; and a slide rail extending in a direction perpendicular to the central axis of the reel, the reel is slidably mounted on the slide rail, a length of the starting end of the cable coiled around the reel is adjustable by moving the reel along the slide rail and rotating the reel around the central axis in a state in which the gripper is separated from the reel and fixed at a predetermined position.

2. The cable coiling system of claim 1, further comprising a cutting device configured to cut off the cable at a feeding side of the reel after the cable is coiled around the reel, a length of a terminating end of the cable coiled around the reel is equal to the length of the starting end.

3. The cable coiling system of claim 2, wherein a total length of the cable includes a length of a coiled section of the cable directly coiled around the reel, the length of the starting end not coiled around the reel, and the length of the terminating end not coiled around the reel.

4. The cable coiling system of claim 2, further comprising a slider slidably assembled on the slide rail, the reel rotatably mounted on the slider.

5. The cable coiling system of claim 3, wherein the total length of the cable is equal to a predetermined total length by controlling the length of the coiled section, the length of the starting end, and the length of the terminating end.

6. The cable coiling system of claim 3, further comprising a slider slidably assembled on the slide rail, the reel rotatably mounted on the slider.

7. The cable coiling system of claim 5, wherein the length of the coiled section is determined by an outer diameter of the reel and a number of turns of the cable coiled around the reel, the length of the coiled section is controlled by controlling the number of turns of the cable coiled around the reel.

8. The cable coiling system of claim 5, further comprising a slider slidably assembled on the slide rail, the reel rotatably mounted on the slider.

9. The cable coiling system of claim 7, wherein the number of turns of the cable coiled around the reel is controlled by controlling a number of rotations of the reel during coiling the cable.

10. The cable coiling system of claim 7, further comprising a slider slidably assembled on the slide rail, the reel rotatably mounted on the slider.

11. The cable coiling system of claim 1, further comprising a slider slidably assembled on the slide rail, the reel rotatably mounted on the slider.

12. The cable coiling system of claim 11, further comprising a first driving device mounted on the slider and configured to drive the reel to rotate around the central axis.

13. The cable coiling system of claim 12, wherein the first driving device has a servo motor, the reel is connected to an output shaft of the servo motor.

14. The cable coiling system of claim 12, further comprising a second driving device configured to drive the reel to move along the slide rail.

15. The cable coiling system of claim 14, wherein the second driving device includes an air cylinder or a hydraulic cylinder including a cylinder body and a piston rod, the piston rod of the second driving device is coupled onto the slider to push the slider and the reel to move along the slide rail.

16. The cable coiling system of claim 1, further comprising a cable coil bundling device configured to wrap a tape onto the cable coil.

17. The cable coiling system of claim 16, further comprising a slidable guide rail, the cable coil bundling device is slidably mounted on the slidable guide rail so as to move along the slidable guide rail between a working portion at which the cable coil is bundled and a non-working portion away from the cable coil.

18. The cable coiling system of claim 17, further comprising a bundling slider slidably assembled on the slidable guide rail, the cable coil bundling device mounted on the bundling slider.

19. The cable coiling system of claim 18, further comprising a driving mechanism configured to drive the cable coil bundling device to move along the slidable guide rail.

20. The cable coiling system of claim 19, wherein the driving mechanism includes an air cylinder or a hydraulic cylinder including a cylinder body and a piston rod, the piston rod of the driving mechanism is coupled onto the bundling slider so as to push the bundling slider and the cable coil bundling device to move along the slidable guide rail.

* * * * *